United States Patent [19]

Collier et al.

[11] Patent Number: 4,870,445

[45] Date of Patent: Sep. 26, 1989

[54] TONER FUSER APPARATUS

[75] Inventors: Barry J. Collier, Henlow; Joseph F. Hale, Welwyn; Ian Pitts, Cambridge, all of England

[73] Assignee: Xerox Corporation, Stamford, Conn.

[21] Appl. No.: 208,345

[22] Filed: Jun. 17, 1988

[30] Foreign Application Priority Data

Jun. 22, 1987 [GB] United Kingdom ..... 871487

[51] Int. Cl.[4] ..... G03G 15/20

[52] U.S. Cl. ..... 355/282; 355/290

[58] Field of Search ..... 355/3 FU, 3 R, 14 FU; 219/216; 118/60

[56] References Cited

U.S. PATENT DOCUMENTS

| | | | |
|---|---|---|---|
| 3,180,278 | 4/1965 | Klein | 103/235 |
| 4,050,801 | 9/1977 | McCarroll et al. | 355/3 R |
| 4,087,676 | 5/1978 | Fukase | 219/216 |
| 4,214,549 | 7/1980 | Moser | 118/60 |
| 4,231,653 | 11/1980 | Nagahara et al. | 355/3 |
| 4,496,234 | 1/1985 | Schram | 355/3 FU |
| 4,512,650 | 4/1985 | Kocher | 355/3 FU |
| 4,541,707 | 9/1985 | Yoshinaga | 355/3 FU |
| 4,571,056 | 2/1986 | Tani et al. | 355/3 FU |
| 4,727,394 | 2/1988 | Bov, Jr. et al. | 355/3 FU |
| 4,777,903 | 10/1988 | Wilcox | 118/60 |

FOREIGN PATENT DOCUMENTS 58-200264 11/1983 Japan .

*Primary Examiner*—A. C. Prescott

[57] ABSTRACT

Apparatus for applying release oil to a fuser roller pair (10*a*, 10*b*) ina xerographic copier comprises an elongate trough (41) containing a supply of oil (42) in the base (44) thereof, and a wick (45) for drawing up the oil from the trough and applying it to a metering roller (47). The metering roller applies the oil to a doner roller (48) which in turn transfers the oil to the heated roller (10*a*) of the fuser roller pair. The amount of oil on the metering roller (47) is checked by a blade (49) and surplus oil removed by the blade is allowed to fall back towards the trough. In order to promote enhanced distribution of oil along the length of the trough a series of ramps (51*a*, 51*b*, 51*c*) is sawtooth configuration is provided in or adjacent a side wall of the trough beneath the blade (49) to receive the oil removed from the metering roller before it is returned to the base (44) of the trough. The base of the trough may slope in the opposite direction to the ramps to establish continuous circulation for the oil.

10 Claims, 6 Drawing Sheets

TONER FUSER APPARATUS

BACKGROUND OF THE INVENTION

This invention relates generally to an apparatus for fusing images on copy substrates, and more particularly to such an apparatus, which affects fusing by the combined application of heat and pressure. This fusing apparatus is suitable for use in an electrostatographic recording machine such as, for example, a xerographic copier.

In a xerographic copier a light image of an original document to be reproduced is recorded in the form of a latent electrostatic image on a photosensitive member. The latent image is rendered visible by the application of a resin-based powder known as toner. The visual toner image is transferred electrostatically from the photosensitive member on to sheets of paper or other substrates. The toner image is then fixed or "fused", for example by applying heat and pressure, which causes the toner material to become soft and tacky whereby it is able to flow into the fibers or pores of the substrate or otherwise upon the surface thereof. Thereafter, as the toner material cools, it solidifies and is bonded firmly to the substrate. In the electrostatographic art generally the use of thermal energy and pressure for fixing toner images on to a substrate is well known.

It has long been recognized that one of the fastest and most positive methods of applying both heat and pressure for fusing the toner image to the substrate is by direct contact of the resin-based toner image with a hot surface such as a heat roller which also applies pressure to the substrate. One approach is to pass the substrate with the toner image thereon between a pair of opposed rollers forming a nip, at least one of the rollers being internally heated. The actual temperature and pressure ranges will of course vary depending upon the softening range of the particular resin used in the toner. Typically, however, it will be necessary to heat the toner powder above 180° C. Temperatures of 198° C. or even higher are not uncommon in commercial fusers. Corresponding nip pressures are in the range of 690 to 1380 kNm2.

A problem with this kind of fuser is that, as the toner becomes tacky, it can stick to the surface of the fuser roller which is undesirable because some of the toner on the fuser roller can then be transferred to subsequent substrates being fused and, moreover, those subsequent substrates will in their turn give rise to even more toner sticking to the fuser roller. This effect, known as "offset", clearly impairs copy quality. Furthermore, if the rollers are rotated when there is no substrate present in the nip therebetween, toner may also be transferred from the fuser roller to the backup roller so that when a substrate subsequently passes through the nip some of the toner may be transferred to the reverse side thereof.

An arrangement for minimizing the problem of offset has been to provide a fuser roller with an outer surface or covering of, for example, polytetrafluoroethylene known by the trade name Teflon, to which a liquid release agent such as silicone oil is applied. The thickness of the Teflon is typically of the order of tens of microns and the thickness of the oil is less than 1 micron. Silicone based oils, for example polydimethylsiloxane, which possess a relatively low surface energy, have been found to be suitable for use in the heated fuser roller enviroment where Teflon constitutes the outer surface of the fuser roller. In practice, a thin layer of silicone oil is applied to the surface of the heated roller to form an interface between the roller surface and the toner images carried on the substrate. Thus, a low surface energy layer is presented to the toner as it passes through the fuser nip thereby preventing toner from offsetting to the fuser roller surface.

In attempts to improve the quality of the image fused by a heat roller fuser, such rollers have been provided with conformable surfaces comprising silicone rubber or Viton (Trademark of E I Du Pont for a series of fluoroelastomers based on the copolymer of vinyladinefluoride and hexafluoropropylene). As in the case of the Teflon coated fuser roller, release fluids such as silicone based oils are applied to the surface of the silicone rubber or Viton to both minimize offsetting and to facilitate stripping. When the fuser system is one which provides for applying silicone oil to silicone rubber or Viton, a low viscosity silicone oil (i.e. in the order of 100 to 1000 centistokes) has most commonly been employed, although liquids of relatively high viscosity, for example 12,000 to 60,000 centistokes and higher, have also been used.

Various forms of applicator have been employed to supply the liquid release agent to the surface of the fuser roller. Thus, for example, U.S. Pat. No. 4 231 653 discloses an applicator comprising an elongate trough for containing a supply of release oil. A wick which is partially immersed in the release oil supply draws the oil up from the trough for application to the fuser via a pair of cooperating rollers in pressure contact, namely a driven oil application roller and a freely rotatable oil supply roller. The wick is in engagement with the oil supply roller and thus applies the release oil directly to the surface thereof. The oil supply roller slips on the application roller and is not rotated when there is some oil present between the two rollers, but as the oil runs out the oil supply roller is driven by the oil application roller since the coefficient of friction therebetween is increased. In other words, the oil supply roller is rotated only when there is little or no oil on the surface of the oil application roller due to the application of oil to the fuser and thus the cooperating roller pair acts as a metering device for checking the amount of release oil conveyed to the fuser.

U.S. Pat. No. 4 050 801 discloses a release oil applicator also comprising an elongate trough containing a supply of release oil. Again the oil is drawn up by a wick which is partially immersed therein but, in this case, the wick is in engagement with the fuser roller so that the oil is applied directly to the surface thereof. The amount of release oil is checked once it has actually been applied to the fuser roller and for this purpose there is employed a doctor blade disposed adjacent the surface of the fuser roller, which scrapes off any surplus oil. The doctor blade may be made of any suitable material, e,g, a fluorosilicate elastomer.

U.S. Pat. No. 4 214 549 discloses an applicator in which release oil is contained in a trough-like sump from which it is dispensed by means of a metering roller which cooperates with a donor roller. The metering roller is partially immersed in the oil in the sump and the donor roller contacts the surface of the heated fuser roller. A wick which is fully immersed in the oil in the trough contacts the metering roller to promote the application of oil thereto. A doctor blade fabricated from VITON (trademark) contacts the metering roller and checks the thickness of the oil coating on the surface thereof. Surplus oil removed from the metering roller is able to return to the sump below.

Generally in prior art applicators the release oil is introduced into the supply trough at a single inlet usually at one end of the trough and distribution of the oil along the full length of the trough relies (a) on the oil reaching a level in the trough and (b) on the capillary capability of the wick. These processes tend to be relatively slow especially in view of the viscosity of the release oil and consequently points along the trough remote from the inlet may receive insufficient oil for stripping or may even suffer complete oil starvation particularly if the machine—and hence the trough—is tilted. Raising the amounts of oil and hence the oil level in the trough would aid distribution, but this is an undesirable solution because it increases the risk of oil spillage. The provision of additional oil inlets along the length of the trough would also aid distribution but this would increase cost and may not be possible if stringent space constraints have to be observed.

BRIEF DESCRIPTION OF THE INVENTION

According to the present invention there is provided apparatus for fusing toner images on copy substrates including a heat and pressure fuser and a release oil applicator therefor, the release oil applicator comprising an elongate trough for containing a supply of release oil, means for taking up release oil from the trough for application to the fuser, and a metering device for checking the amount of release oil conveyed to the fuser, characterized in that the trough is provided with at least one ramp extending in the longitudinal direction of the trough and arranged to receive surplus release oil removed from the take up means by the metering device.

The apparatus in accordance with the invention effectively instigates a pumping action which can promote rapid and effective oil delivery along the full length of the trough regardless of machine tilt, and has the advantage that it employs only a simple configuration which does not require any significant extra space compared with prior art applicators. The ramp(s) may be provided in a side wall of the trough and, as the trough is generally molded from plastics material, the ramp(s) can readily be incorporated without increased cost. In this case the ramp(s) and trough are formed integrally as a unit. Alternatively, however, the ramps may be provided on a separate insert located in the trough. Because the surplus oil removed by the metering device is received by the ramp(s) it is redistributed along the length of the trough for re-application to the fuser.

Usually the aim will be to ensure that oil is distributed to points along the trough remote from the inlet and therefore it is preferable if the or each ramp has its higher end nearer the inlet and its lower end remote therefrom. The oil inlet may suitably be provided at one end of the trough, but may alternatively be provided part or midway along, and in this latter case ramps may be provided on both sides of the inlet as discussed in more detail hereinafter.

The rapidity with which the release oil is distributed along the trough depends on the ramp gradient. However, instead of having a single steep ramp a preferred embodiment employs a series of shorter ramps each having substantially the same gradient and arranged end to end in sawtooth configuration.

Preferably the or each ramp is arranged also to return the release oil received thereon back to the trough whence it will again be drawn up by the take up means for re-application to the fuser. Alternatively, the release oil may be returned from the ramp directly to the take up means.

In a particular embodiment the trough is also provided at its base with a channel sloping downwardly from one end of the trough remote from the inlet towards the inlet for returning release oil to the vicinity of the inlet. With this arrangement the release oil may be continuously circulated along the full length of the trough.

DETAILED DESCRIPTION OF THE DRAWINGS

Figure 1:
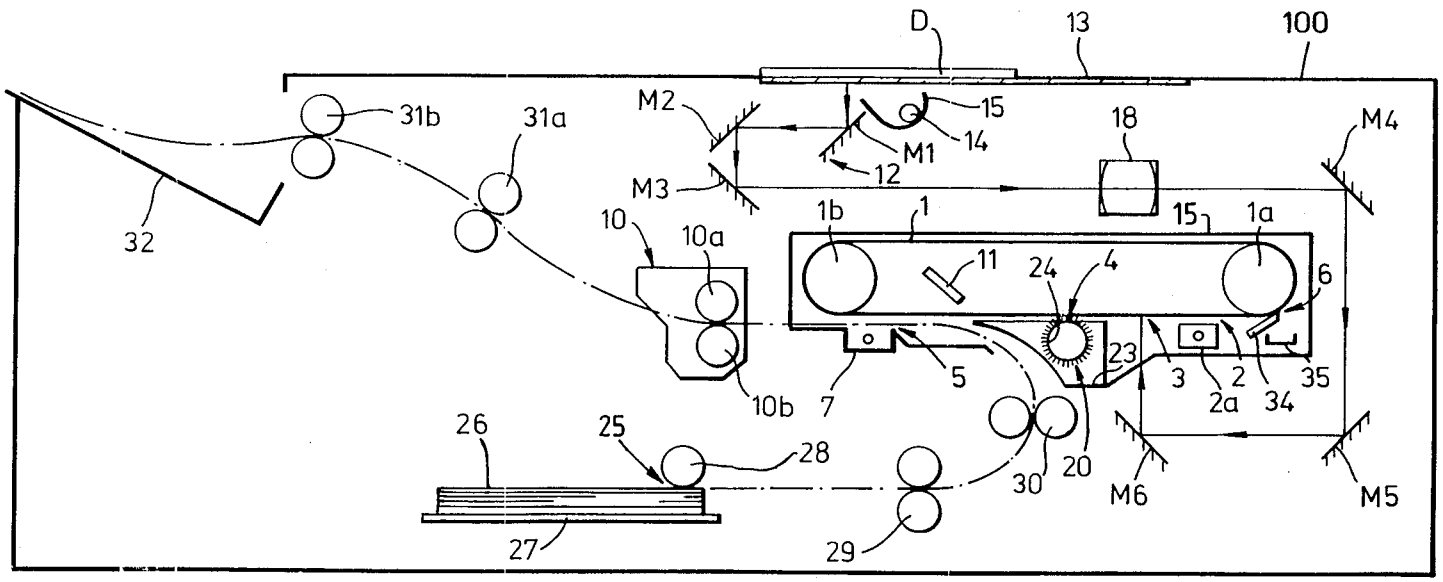
Figure 2:
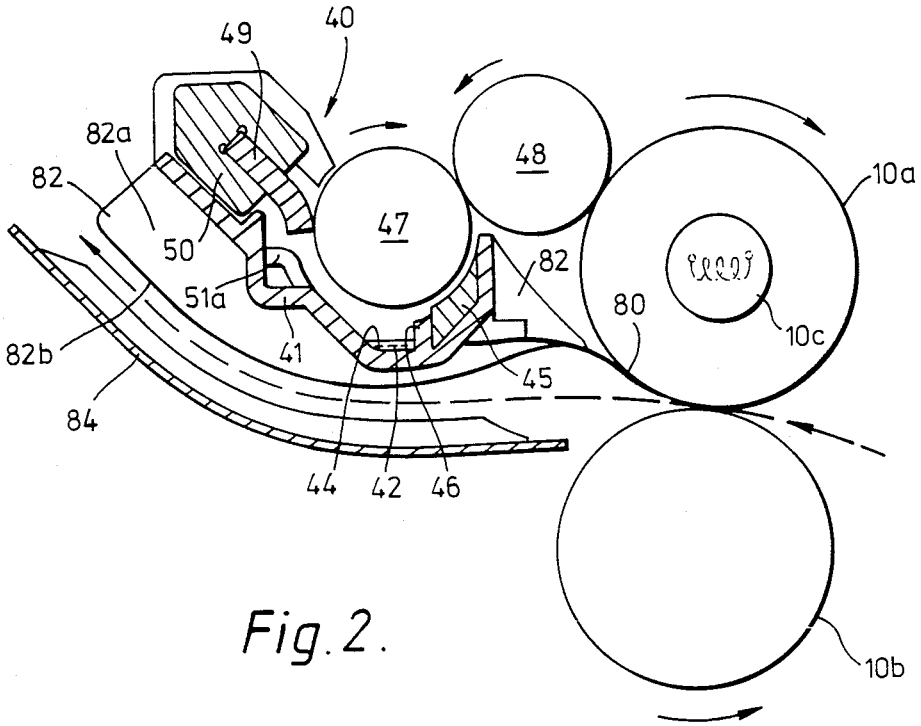
Figure 3:
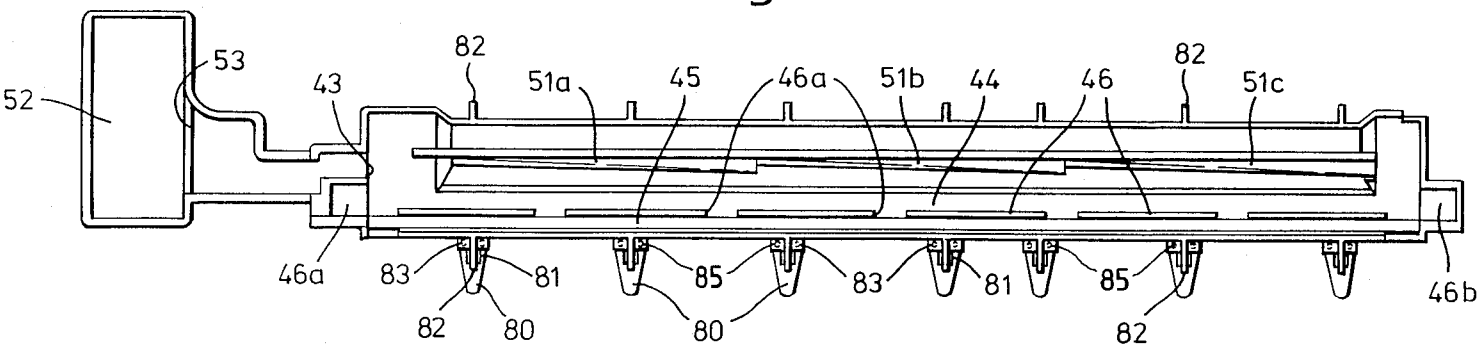
Figure 4:
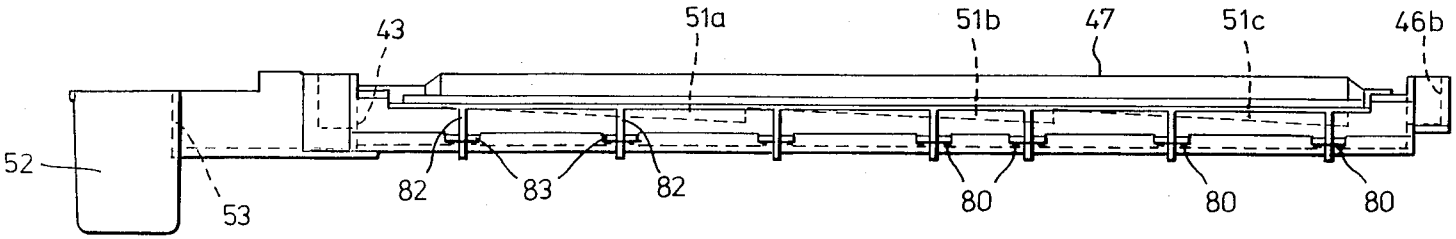
Figure 5:
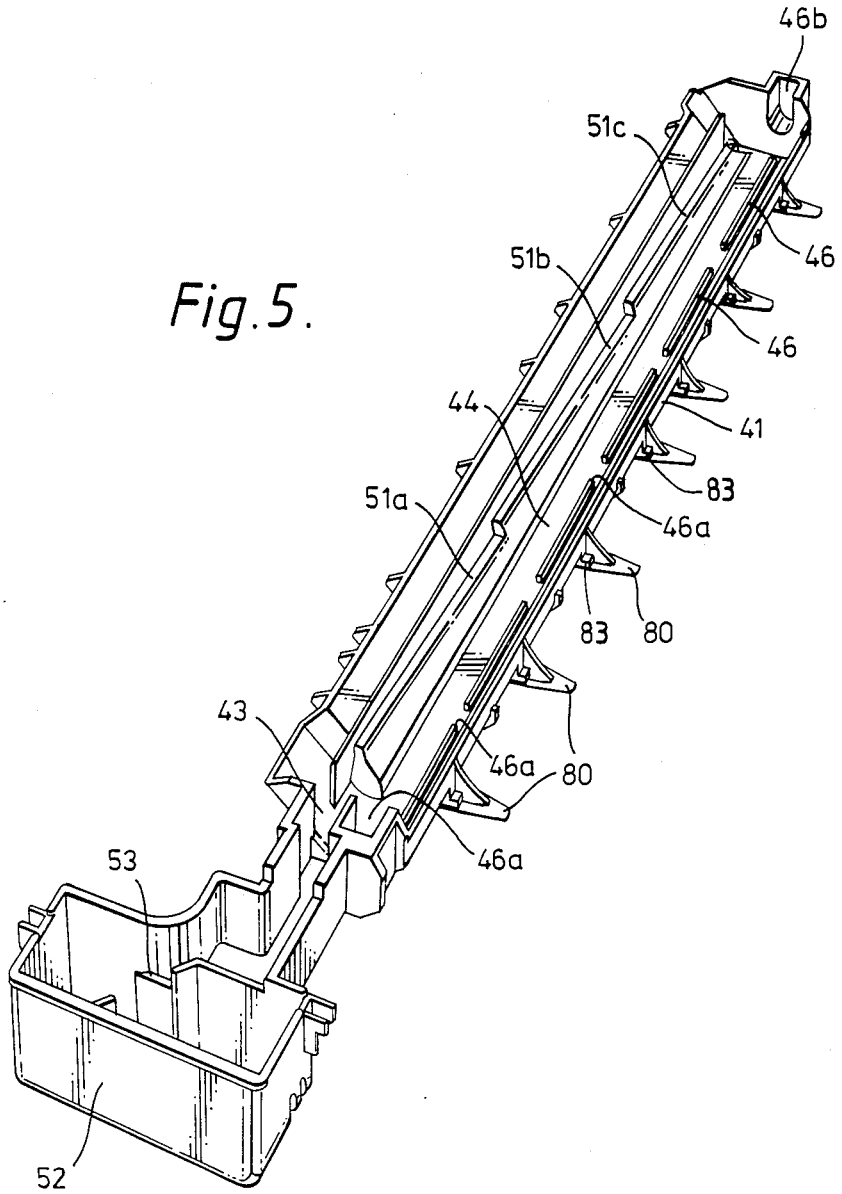
Figure 6:
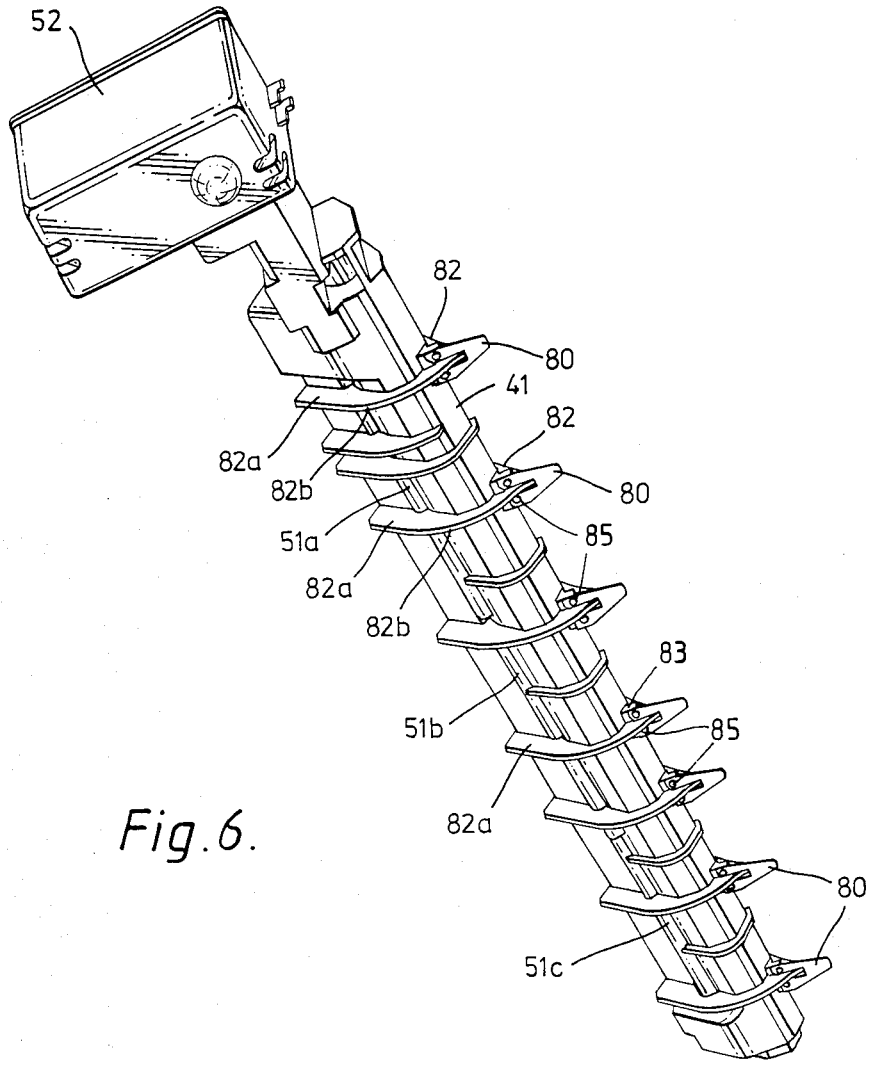

Embodiments of the invention will now be described, by way of example, with reference to the accompanying drawings in which:

FIG. 1 is a schematic cross section of a xerographic copier incorporating a fusing apparatus in accordance with the invention, FIG. 2 is an enlarged cross section of the fusing apparatus employing a release oil applicator in accordance with the present invention, FIG. 3 is a plan view of the applicator trough, FIG. 4 is a front elevation of the applicator trough, FIG. 5 is a perspective view from above showing the inside of the applicator trough, FIG. 6 is a perspective view showing the underside of the applicator trough, and FIGS. *7a* to *7d* show various examples of ramp configurations for the applicator trough.

It is noted that in the various Figures the same reference signs are used to indicate the same features.

DESCRIPTION OF THE PREFERRED EMBODIMENT OF THE INVENTION

Referring first to FIG. 1, there is shown schematically a xerographic copying machine incorporating the present invention. The machine includes an endless flexible photoreceptor belt 1 mounted for rotation (in the clockwise direction as shown in FIG. 1) about support rollers 1*a* and 1*b* to carry the photosensitive imaging surface of the belt 1 sequentially through a series of xerographic processing stations, namely a charging station 2, an imaging station 3, a development station 4, a transfer station 5, and a cleaning station 6.

The charging station 2 comprises a corotron 2*a* which deposits a uniform electrostatic charge on the photoreceptor belt 1.

An original document D to be reproduced is positioned on a platen 13 and is illuminated in known manner a narrow strip at a time by a light source comprising a tungsten halogen lamp 14. Light from the lamp is concentrated by an elliptical reflector 15 to cast a narrow strip oflight on to the side of the original document D facing the platen 13. Document D thus exposed is imaged on to the photoreceptor 1 via a system of mirrors M1 to M6 and a focusing lens 18. The optical image selectively discharges the photoreceptor in image configuration, whereby an electrostatic latent image of the original document is laid down on the belt surface at imaging station 3. In order to copy the whole original document the lamp 14, the reflector 15, and mirror M1 are mounted on a full rate carriage (not shown) which travels laterally at a given speed directly below the platen and thereby scans the whole document. Because of the folded optical path the mirrors M2 and M3 are mounted on another carriage (not shown) which travels laterally at half the speed of the full rate carriagge in order to maintain the optical path constant. The photoreceptor 1 is also in motion whereby the image is laid down strip by strip to reproduce the whole of the original document as an image on the photoreceptor.

By varying the speed of the scan carriages relative to the photoreceptor belt 1 it is possible to alter the size of the image along the length of the belt, i.e. in the scanning direction. In full size copying, that is to say with unity magnification, the speed of the full rate carriage and the speed of the photoreceptor belt are equal. Increasing the speed of the scan carriage makes the image shorter, i.e. reduction, and decreasing the speed of the scan carriage makes the image longer, i.e. magnification.

The image size can also be varied in the direction orthogonal to the scan direction by moving the lens 18 along its optical axis closer to the original document i.e. closer to mirrors M2 and M3, for magnification greater than unity, and away from the mirrors M2 and M3 for reduction, i.e. magnification less than unity. When the lens 18 is moved, the length of the optical path between the lens and the photoreceptor, i.e. the image distance, is also varied by moving mirrors M4 and M5 in unison to ensure that the image is properly focused on the photoreceptor 1. For this purpose mirrors M4 and M5 are suitably mounted on a further carriage (not shown).

At the development station 4, a magnetic brush developer system 20 develops the electrostatic latent image into visible form. Here, toner is dispensed from a hopper (not shown) into developer housing 23 which contains a two-component developer mixture comprising a magnetically attractible carrier and the toner, which is deposited on the charged area of belt 1 by a developer roller 24.

The developed image is transferred at transfer station 5 from the belt to a sheet of copy paper which is delivered into contact with the belt in synchronous relation to the image from a paper supply system 25 in which a stack of paper copy sheets 26 is stored on a tray 27. The top sheet of the stack in the tray is brought, as required, into feeding engagement with a top sheet separator/-feeder 28. Sheet feeder 28 feeds the top copy sheet of the stack towards the photoreceptor around a 180° path via two sets of nip roller pairs 29 and 30. The path followed by the copy sheets is denoted by a broken line in FIG. 1. At the transfer station 5 a transfer corotron 7 provides an electric field to assist in the transfer of the toner particles thereto.

The copy sheet bearing the developed image is then stripped from the belt 1 and subsequently conveyed to a fusing station 10 which comprises a heated roller fuser to which release oil is applied as described in more detail below. The image is fixed to the copy sheet by the heat and pressure in the nip between the two rollers **10*a* and 10*b* of the fuser. The final copy is fed by the fuser rollers into catch tray 32 via two further nip roller pairs 31*a* and 31*b***.

After transfer of the developed image from the belt some toner particles usually remain on the surface of the belt, and these are removed at the cleaning station 6 by a doctor blade 34 which scrapes residual toner from the belt. The toner particles thus removed fall into a receptacle 35 below. Also, any electrostatic charges remaining on the belt are discharged by exposure to an erase lamp 11 which provides an even distribution of light across the photoreceptor surface. The photoreceptor is then ready to be charged again by the charging corotron **2*a*** as the first step in the next copy cycle.

The photoreceptor belt 1, the charge corotron **2*a*, the developer system 20, the transfer corotron 7, the cleaning station 6, and the erase lamp 11 may all be incorporated in a process unit 15 adapted to be removably mounted in the main assembly 100** of the xerographic copier.

As shown in more detail in FIG. 2, the fuser 10 comprises a driven heat roller **10*a* made for example of a steel cylinder coated in Viton (Trademark) and having a 1KW tungsten filament lamp 10*c* disposed along its axis. A driven pressure roller 10*b* which may also comprise a steel cylinder with a Viton coating is urged against the heat roller 10*a*, for example by springs (not shown) suitably applying a force of approximately 68 kg, thereby forming a nip between the two rollers 10*a* and 10*b*** where fusing takes place.

The path of a copy sheet through the fuser is represented by a broken-line arrow in FIG. 2. In order to prevent toner offset and to aid stripping the copy sheet from the heat roller **10*a*, a silicone lubricating oil is applied to the surface roller 10*a* by an applicator 40**.

The oil applicator 40 comprises an elongate trough 41 which is also shown in different views in FIGS. 3 to 6. The release oil 42 is introduced into the trough 41 from a supply source (not shown) at an inlet 43 at one end and flows along a channel 44 at the base of the trough towards the opposite end thereof. A wick 45 is retained internally adjacent the side of the trough by a castellated wall 46 extending upwardly from the base of the trough. It is noted that, for the sake of clarity, the wick is not shown in the perspective view of the trough in FIG. 5. Release oil is able to flow through the gaps **46*a* in the wall 46 to reach the wick 45 which draws the oil up and applies it to the surface of a metering roller 47 against which the wick 45 engages. The metering roller 47, in the form of a tube made for example of stainless steel is journalled in bearings 46*a* and 46*b* at the extremities of the trough 41. The manner in which the metering arrangement operates is described in detail below. The metering roller applies the release oil to a donor roller 48 with which it is in contact and the donor roller 48 transfer a controlled amount of oil to the surface of the heat roller 10*a*. The donor roller 48 may be in the form of a tube made of for example aluminum coated with silicone rubber. The direction of rotation of all the rollers is shown by short solid-line arrows in FIG. 2, but it is noted that only the heat roller 10*a* is directly driven. The pressure roller 10*b*, the donor roller 48 and metering roller 47 are both driven by the heat roller 10*a***.

A metering blade 49 which may be made for example of an elastomer such as Viton (trade mark) is fixed in a holder 50 with the holder end of the blade set at a predetermined distance from the surface of the metering roller 47 thus controlling the loading of the blade on the roller 47. In this manner the blade removes surplus oil from the roller 47 in a cutting tool fashion to leave thereon a coating of a predetermined thickness.

The metering blade 49 is arranged such that the surplus oil removed from the roller 47 will find its way under gravity back to channel 44 in the base of trough 41. However, in accordance with the invention, a series of three similar ramps **51*a*, 51*b*, 51*c* are disposed in sawtooth configuration along the full length of the side wall of the trough directly below the metering blade 49. Oil which is removed from roller 47 by the blade 49 falls onto the ramps 51***a*, 51*b*, 51*c* and fills the space between the ramps and the roller 47. The direction of rotation of roller 47 tends to prevent the oil falling directly back into the channel 44 at the bottom of the trough. Instead the oil flows down the ramps under gravity before spilling over the edge back into the channel 44 at the bottom of the trough. This arrangement ensures rapid and effective distribution of the release oil along the full length of the trough as follows.

Consider the situation where release oil has been introduced into the trough at inlet 43 but has traveled only a very short distance along the channel 44 so that only a small portion of the wick 45 nearest the inlet 43 has been able to draw up any oil. In operation, the metering roller 47 will be rotated and release oil will be coated on the surface thereof by the wick, but only at the end nearest the inlet 43. However, surplus oil cutback therefrom by blade 49 will fall onto the first ramp 51*a* and will flow along the length thereof before spilling over back into the channel 44 further towards the center of the trough. This oil will then be reabsorbed by the wick and again applied to the metering roller 47, but at this stage at least one third of the roller 47 will be wetted. Again excess oil will be removed by blade 49, but this time it will also drop on to the middle ramp 51*b* which will cause the oil to be distributed along the central third of the trough. Then the oil will be drawn up by the adjacent parts of the wick 46, applied to the roller 47 and the excess oil removed by the blade 49 will then fall on to the third ramp 51*c* ensuring that the oil is distributed along the full length of the trough.

In order to set up a complete continuous circulation system the channel 44 at the base of the trough 41 may slope gently downwards from the end adjacent ramp 51*c* to the end of the trough adjacent input 43. Any excess oil may then be collected in a reservoir 52 adjacent input 43 and the level of supply oil in the trough may be set at a desired limit by providing a dam 53 at the entrance to the reservoir at a predetermined heigth so that only when the oil level exceeds the desired level will it spill over the dam into the reservoir.

The ramp and sloping return channel configuration described above is shown schematically in FIG. 7*b* wherein the solid line arrow arrows show the direction of distribution of oil along the trough length and the broken line arrows show the direction of the oil returning to the inlet. Vertically, the FIG. is divided into two portions labeled W and B respectively, W representing the wall portion of the trough and B the base or channel portion.

Figure 7A:
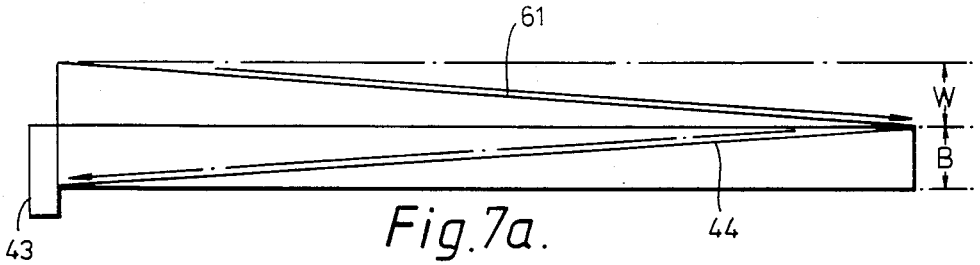
Figure 7B:
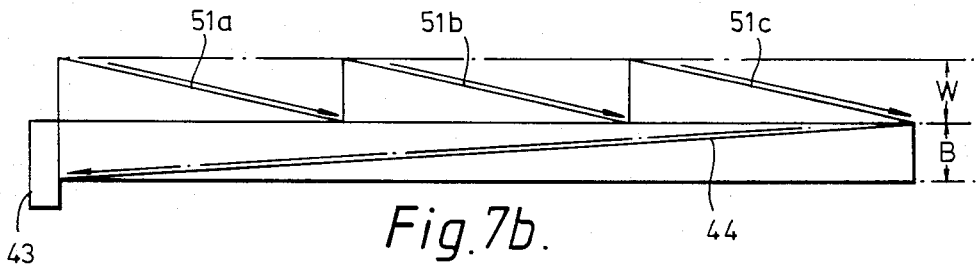

The reason for choosing three ramps was to achieve an optimum gradient within the length of the trough. Clearly more ramps may be employed if a steeper gradient—and hence more rapid oil distribution—is required, or fewer ramps may be employed if a less steep gradient—and hence a less rapid oil distribution—will suffice. FIG. 7*a* shows schematically a single ramp 61 configuration and by comparison with FIG. 7*b* it can easily be seen how the ramp 61 is less steep than its counterpart ramps 51*a*, 51*b*, 51*c* in the FIG. 7*b* embodiment. The sloping channel 44 for returning the oil in a circulatory system is exactly the same as that in the FIG. 7*b* example.

Figure 7C:
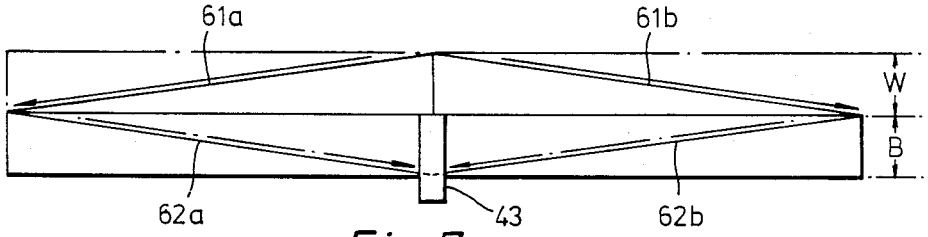

In the embodiments described so far the oil inlet has been disposed at one end of the trough but the inlet may in fact be located anywhere along the trough. FIG. 7*c* shows an example where the inlet 43 is located approximately midway along the length of the trough. In this case two ramps 61*a*, 61*b* are provided each with their highest point adjacent the inlet 43 and their lowest point remote therefrom in order to promote distribution of the oil in both directions along the trough. Also the base channel of the trough may be provided with two slopes to return the oil delivered to the ends of the trough back towards the inlet 43 and hence establish continuous circulation.

Figure 7D:
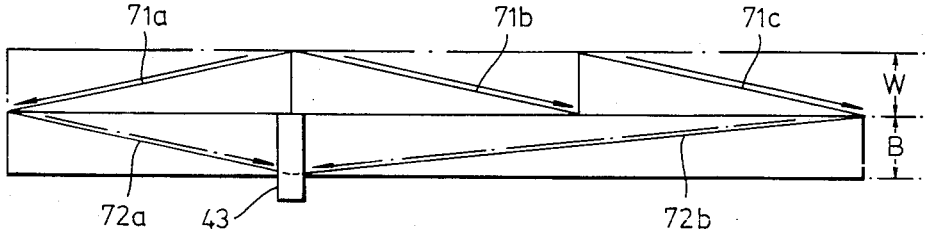

It will be evident from the foregoing that the location of the oil inlet 43 and the number of ramps may be varied according to circumstances without departing from the scope of the invention. As a further example, FIG. 7*d* shows a configuration in which the inlet 43 is provided one third of the way along the length of the trough. In this case a single ramp 71*a* is provided to the left of the inlet as viewed in the Figure, sloping downwardly away therefrom; and two stepped ramps 71*b*, 71*c* on the right side of the inlet 43 both with their highest points nearest the inlet and their lowest points remote therefrom. Two return slopes 72*a*, 72*b* are provided in the channel at the base of the trough; slope 72*a* on the left-hand side of the inlet 43 to return oil delivered to the channel from the end of ramp 71*a*, and slope 72*b* on the right-hand side of inlet 43 to return oil delivered into the channel from the end of ramp 71*c*.

In addition to the release oil, mechanical aids in the form of resilient blade-like stripper fingers 80 are provided at intervals along the length of the fuser system to strip the copy sheet paper from the fuser. To this end the remote end of the finers 80 bears against the heat roller surface on the exit side of the fuser as shown in FIG. 2. As can be seen most clearly in FIGS. 3 to 6, the stripper fingers 80 which may for example be made of steel shim, are tapered and present a truncated V-shaped with the tips of the fingers having a convex curvature. The stripper fingers 80 are fixed directly, to mounting platforms 83 by means of projections integral with the external wall of the trough 41, which are heat staked to form a rivet head 85. Each finger 80 has a centrally located slot 81 enabling the finger 80 to be fitted on to an external rib 82 formed integrally on the external wall of the trough. During stripping the fingers 80 tend to be deflected upwards in such manner as to increase their curvature adjacent the fuser roller 10*a*. On the upper side of the fingers 80 the ribs 82 protrude further than the slots 81 so that if the fingers are subjected to a particularly strong stripping—and hence bending force, they abut the ribs 82 which thus provide strengthening support preventing them from flipping over in the direction of rotation of the fuser roller 10*a* while at the same time reducing the effective unsupported length so that the fingers tend to curve away from the heat roller 10*a* preventing gouging.

On the underside of the fingers 80 the ribs 82 extend around substantially the whole perimeter of the external wall surface of the trough and flare into wider portions 82*a* away from the stripper fingers 80. The ribs 82*a* have a convex outer edge 82*b*. Each rib 82 is integral with the trough so that the whole item may be molded as a unit for example from plastics material. The ribs 82 form a two-fold function, firstly they act as strengthening members for the trough, and secondly they act as an upper guide device for a copy sheet exiting the fuser rollers. The copy sheet exiting the fuser is also guided on its lower side by a guide member 84 complementary to the curved edge 82*b* of ribs 82. The guide member 84 is suitably made of sheet metal and is mounted on the fuser assembly 10. The guide ribs 82 are provided at intervals along the length of the trough, and are positioned so that one is located near the edge of all common paper sizes to inhibit jams due to edges snagging or curling. The depth of the ribs 82 is sufficient to safeguard against copy sheets contacting the underside of the trough which would generate undesirable drag forces which is beneficial because at this stage the copy sheets are hot and damp and as such their normal dry paper strength is diminshed. Moreover, it will be noted that with this arrangement the stripper fingers 80 are in line with the ribs 82 so that they too function in the same beneficial manner in relation to various paper sizes and form a continuous smooth path in combination with the ribs.

In view of the foregoing description it will be evident to a person skilled in the art that various modifications of the embodiments described may be made within the scope of the present invention. For example, instead of the ramps being provided integrally with the side wall of the trough they may be provided as a separate item fitted or extending into the trough. Thus, for instance, the ramps may be formed as an extension of the blade holder.

What is claimed is:

1. Apparatus for fusing toner images on copy substrates including a heat and pressure fuser and a release oil applicator therefor, the release oil applicator comprising an elongate trough for containing a supply of release oil, means for taking up release oil from the trough for application to the fuser, and a metering device for checking the amount of release oil conveyed to the fuser, characterized in that the trough is provided with at least one ramp extending in the longitudinal direction of the trough and arranged to receive surplus release oil removed from the take up means by the metering device.

2. Apparatus as claimed in claim 1, the trough having an inlet for introducing the release oil into the trough, wherein said at least one ramp has its higher end nearer the inlet and its lower end remote therefrom.

3. Apparatus as claimed in claim 2, wherein the inlet is present at one end of the trough.

4. Apparatus as claimed in claim 3, wherein the trough is provided with a plurality of ramps arranged in sawtooth configuration.

5. Apparatus as claimed in claim 3, wherein the trough is provided with a plurality of ramps each of which has substantially the same gradient.

6. Apparatus as claimed in claim 5, wherein said at least one ramp is arranged to return the release oil received thereon back to the trough.

7. Apparatus as claimed in claim 6, wherein said at least ramp is present in a side wall of the trough.

8. Apparatus as claimed in claim 7, wherein the trough is provided with channel sloping downwardly from one end of the trough remote from the inlet towards the inlet for returning release oil to the vicinity of the inlet.

9. Apparatus as claimed in claim 8, wherein the take up means comprises a wick extending in the trough along the length thereof, and a roller disposed adjacent the wick with its axis substantially parallel to the longitudinal axis of the trough in such manner that a layer of release oil is applied to the surface of the roller by the wick.

10. Apparatus as claimed in claim 9, wherein the metering device comprises a blade disposed adjacent said roller in such manner as to scrape off release oil in excess of a predetermined layer thickness on the surface of the roller.

* * * * *